US010928009B2

(12) United States Patent
Bowman et al.

(10) Patent No.: US 10,928,009 B2
(45) Date of Patent: Feb. 23, 2021

(54) PRESSURE VESSEL BOSS AND BOSS ASSEMBLY APPARATUS AND METHOD

(71) Applicants: Aron Bowman, Prosper, TX (US); Robert G Green, Frisco, TX (US); Jason Petermeier, Prosper, TX (US); Rick Willardson, McKinney, TX (US)

(72) Inventors: Aron Bowman, Prosper, TX (US); Robert G Green, Frisco, TX (US); Jason Petermeier, Prosper, TX (US); Rick Willardson, McKinney, TX (US)

(73) Assignee: eZcomply, LLC, Peoria, IL (US)

( * ) Notice: Subject to any disclaimer, the term of this patent is extended or adjusted under 35 U.S.C. 154(b) by 97 days.

(21) Appl. No.: 14/545,602

(22) Filed: May 29, 2015

(65) Prior Publication Data

US 2016/0348845 A1 Dec. 1, 2016

(51) Int. Cl.
*F17C 13/06* (2006.01)
*F17C 1/04* (2006.01)
*F17C 5/06* (2006.01)

(52) U.S. Cl.
CPC ..... *F17C 13/06* (2013.01); *F17C 1/04* (2013.01); *F17C 5/06* (2013.01); *F17C 2201/0109* (2013.01); *F17C 2201/056* (2013.01); *F17C 2201/058* (2013.01); *F17C 2203/0604* (2013.01); *F17C 2203/0619* (2013.01); *F17C 2203/0663* (2013.01); *F17C 2205/0305* (2013.01); *F17C 2205/0397* (2013.01); *F17C 2209/227* (2013.01); *F17C 2209/228* (2013.01); *F17C 2221/033* (2013.01); *F17C 2223/0123* (2013.01); *F17C 2223/036* (2013.01); *F17C 2260/036* (2013.01); *F17C 2270/01* (2013.01)

(58) Field of Classification Search
CPC .... F17C 1/04; F17C 13/06; F17C 2203/0604; F17C 2270/01; F17C 5/06; F17C 1/02; F17C 2203/0619
USPC ..... 220/601
See application file for complete search history.

(56) References Cited

U.S. PATENT DOCUMENTS 4,917,507 A * 4/1990 Davidson ..... B65D 88/1612 383/121
6,305,845 B1 * 10/2001 Navin ..... B65D 88/1618 383/109
7,731,051 B2 * 6/2010 Rohwer ..... F17C 13/04 220/582
7,857,159 B2 * 12/2010 Lindner ..... F16J 15/062 220/586

(Continued)

*Primary Examiner* — James N Smalley
*Assistant Examiner* — Madison L Poos
(74) *Attorney, Agent, or Firm* — Golden's M&I

(57) ABSTRACT

This invention relates to a boss assembly that seals a pressure vessel and more particularly to sealing a pressure vessel having a composite outer shell for use with a source of compressed gas having a boss and boss cover in sealing engagement. The composite outer shell is wound about the boss and locked into at least one notch and/or a reverse draft cut. The boss cover is removably fastened to the boss utilizing at least one fastener. The principle use is for storage and usage of compressed gas in mobile applications that typically benefit from light weight pressure vessels however other applications will benefit from this invention. For example, applications that routinely fill and/or un-fill containers made of woven, composite, and etc. materials will benefit from this invention.

17 Claims, 1 Drawing Sheet

DETAIL A

(56) References Cited

U.S. PATENT DOCUMENTS

| | | | | |
|---|---|---|---|---|
| 8,967,417 | B2 * | 3/2015 | Sharp | F17C 1/16 220/203.25 |
| 2010/0181325 | A1 * | 7/2010 | Jenkins | F17C 13/06 220/586 |
| 2011/0220661 | A1 * | 9/2011 | Strack | F16J 12/00 220/586 |
| 2014/0144866 | A1 * | 5/2014 | Heo | F17C 1/06 215/45 |
| 2015/0197382 | A1 * | 7/2015 | Aoe | B65D 25/14 206/524.3 |
| 2018/0194549 | A1 * | 7/2018 | Chartrel | B65D 88/165 |

* cited by examiner

DETAIL A

PRESSURE VESSEL BOSS AND BOSS ASSEMBLY APPARATUS AND METHOD

TECHNICAL FIELD

This invention relates generally to a boss and boss assembly that seals a pressure vessel and more particularly to sealing a pressure vessel having a composite outer shell.

BACKGROUND ART

With the increase in natural gas exploration in more remote locations it has become desirable to provide gas storage systems that are mobile. With mobile natural gas systems it's beneficial to store and transport in large quantities and one example is a Type IV fluid pressure vessel. To accommodate larger quantities of natural gas transport, non-metallic pressure vessels have been designed to reduce the weight of the pressure vessel when compared to metallic pressure vessels know in the art.

Typical non-metallic pressure vessels are comprised of an outer shell, a liner, and a boss. The outer shell is designed to withstand certain internal pressure loads which would typically cause the vessel to expand. The outer shell is designed to restrict this expansion and absorb the internal stress caused by the pressure load. The liner is designed to prevent any leakage of the fluid that is being contained by the pressure vessel. It can withstand cyclic expansions and contractions that are the result of the filling and un-filling of the pressure vessel without failing. The boss is designed to close out the ends of the pressure vessel by connecting the outer shell with the liner and providing for a place for a fitting to be attached and is used during the filling and un-filling of the vessel.

One problem with non-metallic fluid pressure vessels is the ability to securely attach the boss to the outer shell and liner. The boss will see several different types of load cases during its life, and if it is not securely attached to the outer shell and liner, over time it will create leak path(s) for the fluid to escape. The load cases that the boss may encounter includes rotational force due to the threading in of the fitting used for filling, inward axial force due to either a vacuum pressure that occurs inside the tank or an impact from dropping the vessel on its end, and an outward axial force due to the pressure build up on the inside of the tank due to its normal use.

The present invention is directed to overcoming one or more of the problems set forth above.

DISCLOSURE OF THE INVENTION

In one aspect of the instant invention, a boss for use with a pressure vessel has a cover end that has at least one fastener bore, and a cavity end. A transitional portion is located between the cover end and the cavity end, and has at least one notch disposed therein. A filling bore is defined by a first curvilinear surface and a longitudinal axis.

In another aspect of the instant invention, a boss assembly for use with a pressure vessel has a boss that has a cover end, a cavity end, a transitional portion, and a filling bore. The cover end has at least one fastener bore. The transitional portion is located between the cover end and the cavity end and has at least one notch disposed therein. The filling bore is defined by a first curvilinear surface and a longitudinal axis. A boss cover has at least one through hole disposed there through and in general alignment with the at least one fastener bore, and a fill fitting. At least one fastener is generally inserted through the at least one through hole and engages the at least one fastener bore.

In yet another aspect of the present invention, a pressure vessel for use with compressed gas has a pair of bosses that has a cover end, a cavity end, a transitional portion, and a filling bore. The cover end has at least one fastener bore. The transitional portion is located between the cover end and the cavity end and has at least one notch disposed therein. The filling bore is defined by a first curvilinear surface and a longitudinal axis. A pair of boss covers has at least one through hole disposed there through and in general alignment with the at least one fastener bore, and a fill fitting. At least one fastener generally inserted through the at least one through hole and engaging the at least one fastener bore. An outer shell that is disposed between the pair of bosses and has a liner and an overwrap, the overwrap is wound onto the liner and the pair of bosses.

In yet another aspect of the present invention, a method of filing a pressure vessel for use with compressed gas with at least one boss that has at least one fastener bore. A boss cover has at least one through hole, a first and second O-ring that is generally disposed in first and second recesses, and a fill fitting, at least one fastener, and a source of compressed gas. The method comprises the steps of installing the source of compressed gas into said fill fitting. Aligning the boss cover at least one through holes with the at least one fastener bore. Inserting the at least one fastener through at least one through hole and into the at least one fastener bore. Tightening the at least one fastener until the boss and the cover is in general sealed engagement.

BEST MODE FOR CARRYING OUT THE INVENTION

Figure 1:
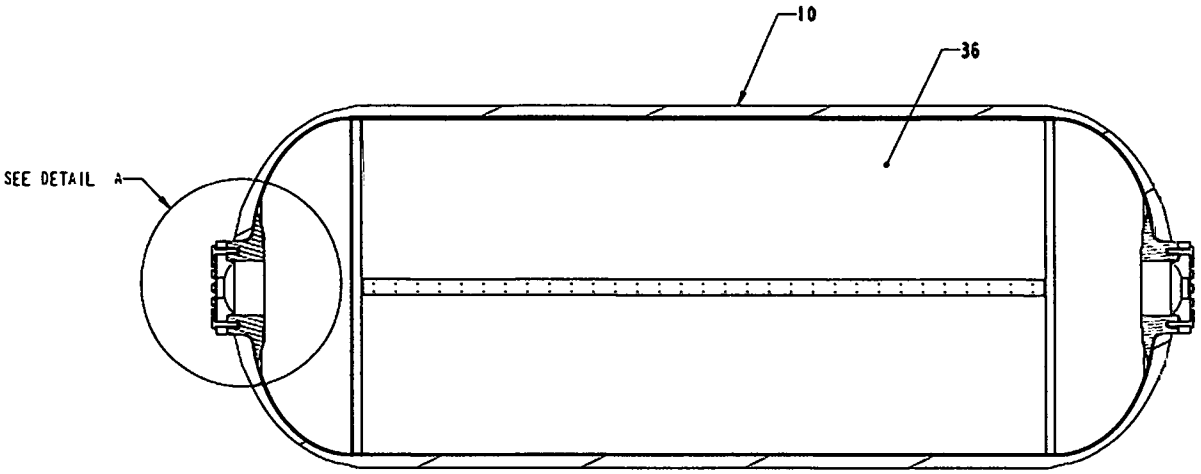
FIG. 1 is a diagrammatic cross-sectional view of a non-metallic pressure vessel embodying the present invention.

Turning to the drawings and particularly to FIG. 1, a cross-sectional view of a non-metallic pressure vessel (10) is shown in one embodiment of the present invention. As seen therein, the boss assembly (12) includes a boss (14), a boss cover (16), at least one fastener (18), and a pair of O-rings (20). In the preferred embodiment, the boss (14) and the boss cover (16) are made of a lightweight material, such as, aluminum, composites, plastics, and the like without departing from the spirit of the invention. The boss assembly (12) is used with non-metallic pressure vessels (10) that are typically designed utilizing an outer shell (22) and a liner (24). The outer shell (22) is designed to withstand certain internal pressure loads which would typically cause the non-metallic pressure vessel (10) to expand. The outer shell (22) is designed to restrict this expansion and absorb the internal stress caused by the pressure load. The liner (24) is designed to prevent any leakage of the fluid that is being contained by the non-metallic pressure vessel (10). The liner (24) can withstand cyclic expansions and contractions that are the result of the filling and un-filling of the non-metallic pressure vessel (10) without failing. The boss assembly (12) is designed to close out the non-metallic pressure vessel (1)

with a connection between the outer shell (22) and the liner (24) and also provides a fill fitting (26) that may be attached to a source of compressed gas (not shown) during the filling and un-filling of the non-metallic pressure vessel (10).

Figure 3:
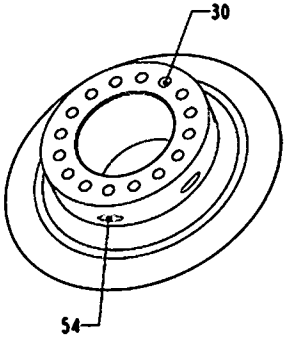
FIG. 3 is a diagrammatic isometric view of the boss embodying the present invention.
Figure 2:
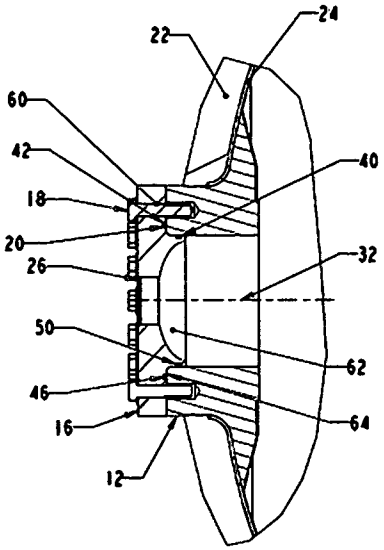
FIG. 2 is a diagrammatic detail cross-sectional view of the boss assembly embodying the present invention.

Referring to FIG. 2 and FIG. 3, the boss (14) is shown and is part of the boss assembly (12). The boss (14) has a cover end (28) that is typically a machined surface that provides a smooth surface for sealing between the boss (14) and the boss cover (16). The cover end (28) has at least one fastener bore (30). In embodiments with multiple at least one fastener bore (30) are typically equally spaced in a radial pattern about a longitudinal axis (32). However, other configurations may be used without departing from the spirit of the invention. For example, different radial distances, un-equal spacing, and the like without departing from the spirit of the invention. The at least one fastener bore (30) is generally threaded corresponding to the at least one fastener (18). It should be recognized that other releasable fastening configurations that are well known in the art may be used without departing from the spirit of the invention.

Referring to FIG. 3, a cavity end (34) is spaced from the cover end (28) and is generally adjacent the cavity (36) formed in the non-metallic pressure vessel (10). The cavity end (36) usually includes a chamfer profile (38) to reduce weight of the boss and also provide connection support for the liner (24) and outer shell (22). However, other configurations, such as, flat profiles, rounded profiles, stepped profiles, etc. may be used without departing from the spirit of the invention.

Figure 4:
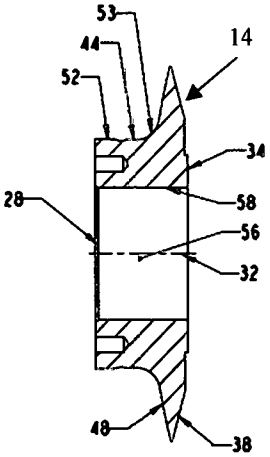
FIG. 4 is a diagrammatic detail cross-sectional view of the boss embodying the present invention.

Referring to FIG. 3 and FIG. 4, a transitional portion (44) is located between the cover end (28) and the cavity end (34) of the boss (14). A reversed draft cut (52) is disposed about an outer surface (48) generally adjacent to the cover end (28). The reverse draft cut (52) generally creates a locking feature between the boss (14) and the outer shell (22). In embodiments where the outer shell (22) is made of an overwrap. The overwrap is wound about the reverse draft cut (52) that creates a generally mechanical lock between the boss (14) and the outer shell (22). The generally mechanical lock typically react out inward axial forces that are applied to the boss (14). A transitional radius cut (53) is disposed about the outer surface (48) and is used to generally provide a smooth directional transition for connection of the liner (24) and the outer shell (22) to the boss (14). In addition, the transitional portion (44) has at least one notch (54) disposed therein. A seal is generally created with the liner (24) bonded to the outer surface (48) of the boss (14) to prevent fluid leakage between the liner (24) and the boss (14). The at least one notch (54) are typically machined into the boss (14) and create "flats" on the generally rounded outer surface (48) of the boss (14). In embodiments where overwrap is applied to the non-metallic pressure vessel (10), the fibers will wind themselves into the at least one notch (54) and essentially locking the overwrap onto the boss (14). It should be recognized that other at least one notch (54) configurations maybe used without departing from the spirit of the invention. For example, the at least one notch (54) may be formed in the outer surface (48) using a sand casting, lost foam, etc. that are previously known in the art. Plus, the profile of the at least one notch, am be circular, elliptical, square, and the like without departing from the spirit of the invention.

Referring to FIG. 4, the boss (14) has a filling bore (56) that is defined by a curvilinear surface (58) and the longitudinal axis (32). The filling bore is adapted to pass fluid into the cavity (36) of the non-metallic pressure vessel (10).

Referring to FIG. 2, the boss cover (16) is shown. The boss cover (16) has at least one through hole (60) disposed there through. The at least one through hole (60) is sized to permit the at least one fastener (18) to pass through. In addition, the at least one through hole (60) is in general alignment with the at least one fastener bore (30), such that, inserting at least one fastener (18) through the at least one through hole (60) and into the at least one fastener bore (30) fastens the boss cover (16) to the boss (14). With proper installation of the boss cover (16) to the boss (14) generally eliminates fluid leak paths between the boss cover (16) and the boss (14). To provide proper alignment and improved sealing the boss cover (16) has an insert portion (62) that is in mating contact filling bore (56) of the boss (14). A step surface (64) generally disposed about the filling bore (56) is used in tandem with the boss (14) to locate the boss cover (16) relative to the boss (14). A recess (40) is formed in the boss cover (16) and disposed about the longitudinal axis (32) and adapted to receive a first O-ring (42). A second recess (46) is formed in the boss cover (16) and disposed about the insert portion (62) and adapted to receive a second O-ring (50). Alternative embodiments may use gaskets, adhesives, and the like without departing from the spirit of the invention. With the boss cover (16) inserted into the boss (14) and fastened to the boss (14) with the at least one fastener (18) and the first and second O-rings (42 & 50) positioned in their corresponding recess (40 & 46) then proper sealing is achieved between the boss cover (16) and the boss (14). However, alternative embodiments, such as, the boss cover (16) with a ring profile, i.e., single surface that mates with the boss (14) may be used without departing from the spirit of the invention. The first and second O-rings (42 & 50) are in generally sealing engagement with the boss cover (16) and the boss (14). The boss cover (16) has a fill fitting (26) that is typically threaded to accommodate attachment of sources of compressed gases (not shown). The fill fitting (26) when assembled to the boss (14) allows fluid to communicate between sources of compressed gas (not shown) to either fill or un-fill the non-metallic pressure vessel (10). As discussed previously with the boss (14), the boss cover (16) may be made from differing materials without departing from the spirit of the invention.

Referring to FIG. 1, the non-metallic pressure vessel (10) is shown with a pair of boss assemblies (12) with the outer shell (22) and liner (24) attached thereto. In one embodiment of the present invention, the outer shell (22) is made of an overwrap that is generally wound onto the liner (24) and the boss (14). The bonding of the liner (24) to the boss (14) with the overwrap in place provides a seal between atmosphere and the cavity (36) of the non-metallic pressure vessel (10). Furthermore, the overwrap may be wound into the at least one notch (54) and about the reverse draft cut (52) to provide additional locking features between the overwrap and the boss (14), increasing the integrity of the non-metallic pressure vessel (10).

INDUSTRIAL APPLICABILITY

With reference to the Figs. and in operation, the integrity of pressure vessels, and in particular, non-metallic pressure vessels (10) is increased due to better sealing between the boss (14), the liner (24), and the outer shell (22). For example, with the overwrap wound about the boss (14) winds fibers into the at least one notch (54) and about the reverse draft cut (52), and thus, basically locks the outer shell (22) to the boss (14). In addition, the ability to fasten the source of natural gas to the boss cover (16) independently of the non-metallic pressure vessel (10) minimizes the magnitude of rotational forces encountered by the non-metallic pressure vessel (10) and improves the useful life of the non-metallic pressure vessel (10).

In operation, the non-metallic pressure vessel (10) is made by bonding the liner (24) to the boss (14) preventing fluid leakage about the boss (14). Once the liner (24) is bonded to the boss (14) then the overwrap, i.e., composite is wound onto the liner (24) and the boss (14), and thus, creates the structural outer shell that typically withstands the designed pressure loads of the non-metallic pressure vessel (10). Furthermore, the compression forces created by applying the overwrap to the liner (24) creates gasket like compression seal between the outer shell (22) and the boss (14). Finally, the boss cover (16) is removably fastened to the boss using the at least one fasteners (18). The fastening of the boss cover (16) to the boss (14) compresses the first and second O-rings (42 & 50), and thus, prevents fluid from leaking through the boss (14) and boss cover (16) interface.

The filling of the pressure vessel, i.e., non-metallic pressure vessel (10) with compressed gas. With the boss cover (16) removed from the boss (14), the user installs the source of compressed gas (not shown) into the fill fitting (26) of the boss cover (16). For example, the source of compressed gas (not shown) is threaded into the fill fitting (26) and torqued to the desired level. With the first and second O-rings (42 & 50) installed into corresponding first and second recesses (40 & 46). Fastening of the boss cover (16) to the boss (14) is achieved by aligning the at least one through hole (60) of the boss cover (16) with the at least one fastener bore (30) of the boss (14). With proper alignment achieved, the at least one fastener (18) is inserted through the at least one through hole (60) and into the at least one fastener bore (30). The at least one fastener (18) is tightened to desired level, such that, the boss (14) and boss cover (16) are in generally sealed engagement. The filling of the non-metallic pressure vessel (10) was discussed, however, one skilled in the art would realize that the un-filling of the non-metallic pressure vessel (10) would be similar in operation.

The invention claimed is:

1. A boss for use with a pressure vessel utilizing an outer shell and a liner, comprising:

a cover end having at least one fastener bore;

a cavity end;

a transitional portion located between said cover end and said cavity end and said transitional portion disposed about an outer surface and generally engages the liner, and having at least one notch disposed therein and said at least one notch adapted to generally seal the liner to the boss; and a filling bore being defined by a first curvilinear surface and a longitudinal axis.

2. The boss for use with a pressure vessel utilizing an outer shell and a liner, as set forth in claim 1, wherein said fastener bore being threaded.

3. The boss for use with a pressure vessel utilizing an outer shell and a liner, as set forth in claim 1, wherein said transitional portion having an outer surface, said outer surface having a reversed draft cut disposed about said outer surface.

4. The boss for use with a pressure vessel utilizing an outer shell and a liner, as set forth in claim 1, wherein said transitional portion having an outer surface, said outer surface having a transitional radius cut disposed about said outer surface.

5. The boss for use with a pressure vessel utilizing an outer shell and a liner, as set forth in claim 1, wherein said cavity end having a chamfer.

6. The boss for use with a pressure vessel utilizing an outer shell and a liner, as set forth in claim 1, wherein said at least one notch having an elliptical profile.

7. The boss for use with a pressure vessel utilizing an outer shell and a liner, as set forth in claim 1, wherein said boss being made from aluminum.

8. A boss assembly for use with a pressure vessel utilizing an outer shell and a liner, comprising:

a boss having a cover end, a cavity end, a transitional portion, and a filling bore, said cover end having at least one fastener bore, said transitional portion located between said cover end and said cavity end and said transitional portion disposed about an outer surface and generally engages the liner and having at least one notch disposed therein and said at least one notch adapted to generally seal the liner to the boss, and said filling bore being defined by a first curvilinear surface and a longitudinal axis;

a boss cover having at least one through hole disposed there through and being in general alignment with said at least one fastener bore, and a fill fitting; and at least one fastener being generally inserted through said at least one through hole and engaging said at least one fastener bore.

9. A boss assembly for use with a pressure vessel utilizing an outer shell and a liner, as set forth in claim 8, wherein said boss cover having an insert portion being in generally mating contact with said boss, and said insert portion having a step surface being generally disposed about said filling bore.

10. The boss assembly for use with a pressure vessel utilizing an outer shell and a liner, as set forth in claim 8, wherein said boss cover having a recess disposed about said longitudinal axis and being adapted to receive a first O-ring, and said first O-ring being in generally sealing engagement with said boss cover and said boss.

11. The boss assembly for use with a pressure vessel utilizing an outer shell and a liner, as set forth in claim 8, wherein said boss cover having an insert portion and a second recess disposed about said insert portion and being adapted to receive a second O-ring, and said second O-ring being in generally sealing engagement with said boss cover and said boss.

12. The boss assembly for use with a pressure vessel utilizing an outer shell and a liner, as set forth in claim 8, wherein said fill fitting being threaded.

13. A pressure vessel for use with compressed gas utilizing an outer shell and a liner, comprising:

a pair of bosses having a cover end, a cavity end, a transitional portion, and a filling bore, said cover end having at least one fastener bore, said transitional portion located between said cover end and said cavity end and said transitional portion disposed about an outer surface and generally engages the liner and having at least one notch disposed therein and said at least one notch adapted to generally seal the liner to the boss, and said filling bore being defined by a first curvilinear surface and a longitudinal axis;

a pair of boss covers having at least one through hole disposed there through and being in general alignment with said at least one fastener bore, and a fill fitting;

at least one fastener being generally inserted through said at least one through hole and engaging said at least one fastener bore; and an outer shell being disposed between said pair of bosses and having a liner and an overwrap, said overwrap being wound onto said liner and said pair of bosses.

14. A pressure vessel for use with compressed gas utilizing an outer shell and a liner, as set forth in claim 13, wherein said overwrap being wound into said at least one notch.

15. A pressure vessel for use with compressed gas utilizing an outer shell and a liner, as set forth in claim 13, wherein said overwrap being wound about said reverse draft cut.

16. A method of filing a pressure vessel for use with compressed gas with at least one boss having at least one fastener bore, a boss cover having at least one through hole, a first and second O-ring being generally disposed in a first and second recesses, and a fill fitting, at least one fastener, and a source of compressed gas the method comprises the steps of;

installing said source of compressed gas into said fill fitting of said boss cover;

fastening said source of compressed gas to said boss cover independently of the non-metallic pressure vessel;

aligning said at least one through holes of said boss cover with said at least one fastener bore of said boss;

inserting said at least one fastener through at least one through hole and into said at least one fastener bore; and tightening said at least one fastener until said boss and boss cover being in generally sealed engagement with said first and second O-ring.

17. A method of filing a pressure vessel for use compressed gas, as set forth in claim 16, wherein said step of installing said source of compressed gas into said fill fitting being torqued to desired level.

* * * * *